US009988228B2

(12) United States Patent
Giannini et al.

(10) Patent No.: US 9,988,228 B2
(45) Date of Patent: Jun. 5, 2018

(54) REWINDING MACHINE

(71) Applicant: O.M.T. DI GIANNINI GRAZIANO E DAMIANO & C. S.N.C., Capannori (Lucca) (IT)

(72) Inventors: Damiano Giannini, Capannori (IT); Graziano Giannini, Capannori (IT)

(73) Assignee: O.M.T. DI GIANNINI GRAZIANO E DAMIANO & C. S.N.C., Capannori (Lucca) (IT)

( * ) Notice: Subject to any disclaimer, the term of this patent is extended or adjusted under 35 U.S.C. 154(b) by 232 days.

(21) Appl. No.: 15/019,077

(22) Filed: Feb. 9, 2016

(65) Prior Publication Data

US 2016/0229652 A1 Aug. 11, 2016

(30) Foreign Application Priority Data

Feb. 10, 2015 (IT) ..... MI2015A0188

(51) Int. Cl.
*B65H 19/22* (2006.01)
*B65H 19/26* (2006.01)
*B65H 19/30* (2006.01)

(52) U.S. Cl.
CPC ..... *B65H 19/2238* (2013.01); *B65H 19/2269* (2013.01); *B65H 19/267* (2013.01); *B65H 19/305* (2013.01); *B65H 2404/265* (2013.01); *B65H 2404/6942* (2013.01); *B65H 2408/235* (2013.01)

(58) Field of Classification Search
CPC ..... B65H 19/267; B65H 19/305; B65H 19/2238; B65H 19/2269
See application file for complete search history.

(56) References Cited

U.S. PATENT DOCUMENTS 6,050,519 A 4/2000 Biagiotti
2008/0283656 A1* 11/2008 Gelli ..... B65H 19/2269 242/521
2008/0290207 A1* 11/2008 Gelli ..... B65H 19/2269 242/521

(Continued)

FOREIGN PATENT DOCUMENTS

EP 2 253 568 A2 11/2010
WO 2007/141819 A1 12/2007

OTHER PUBLICATIONS

Extended European Search Report for EP Application No. 16 15 4600, four pages, dated May 30, 2016.

(Continued)

*Primary Examiner* — Sang K Kim
(74) *Attorney, Agent, or Firm* — Vorys, Sater, Seymour & Pease LLP; Ari Zytcer

(57) ABSTRACT

Provided is a rewinding machine including a winding zone wherein a continuous strip is wound around a core; a movement unit of the continuous strip defining a sliding surface for the continuous strip; a support unit defining a support surface for the core; the support surface is opposite and spaced from the sliding surface so as to define a sliding channel, configured to guide the core in the winding zone; a contrast unit defining a contrast surface; and a tearing tooth configured to press the continuous strip against the contrast surface causing the tearing of the continuous strip; said sliding surface being interposed between the support surface and the contrast surface.

12 Claims, 6 Drawing Sheets

(56) References Cited

U.S. PATENT DOCUMENTS

| | | | | |
|---|---|---|---|---|
| 2009/0001210 | A1* | 1/2009 | Morelli | B65H 19/2269 242/521 |
| 2009/0173819 | A1* | 7/2009 | Maddaleni | B65H 19/2269 242/523.1 |
| 2009/0272835 | A1* | 11/2009 | Benvenuti | B65H 19/2269 242/521 |
| 2009/0302146 | A1* | 12/2009 | Morelli | B65H 19/2269 242/526 |
| 2010/0294875 | A1* | 11/2010 | Tsai | B65H 19/2269 242/521 |

OTHER PUBLICATIONS

Search Report for Italian Application No. MI20150188; two pages; completed Sep. 30, 2015.

* cited by examiner

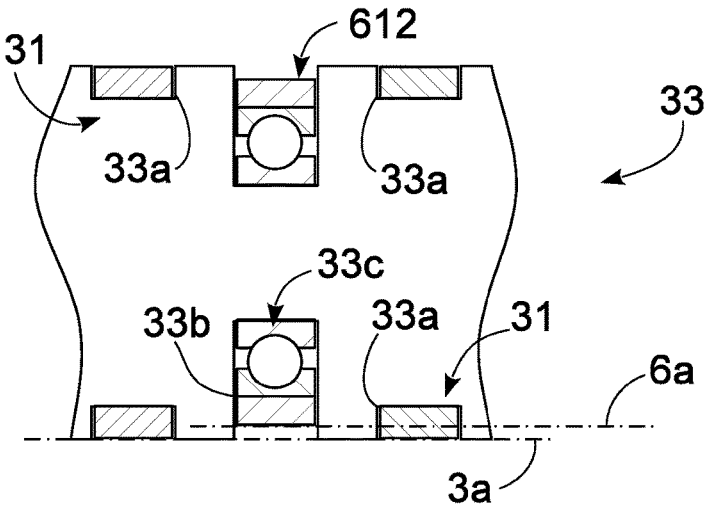
*Fig. 10*
*Fig. 11*
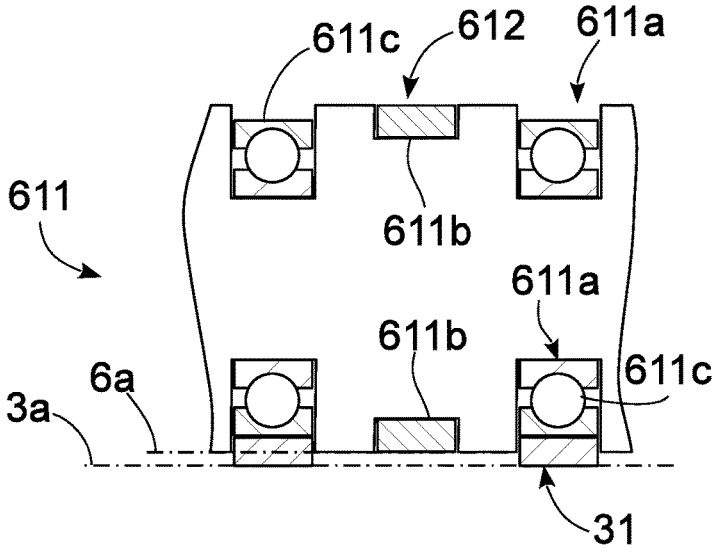

REWINDING MACHINE

TECHNICAL BACKGROUND OF THE INVENTION

The present invention relates to a rewinding machine of the type as recited in the preamble of Claim 1 and comprising a winding zone in which a continuous strip is wound around a core; a movement unit of the continuous strip defining a sliding surface for said continuous strip; and a support unit defining a support surface for the core opposite and spaced from the sliding surface so as to define a sliding channel for the core in the winding zone.

DESCRIPTION OF THE PRIOR ART

As is known, a rewinding machine is composed of a take-up device for winding a continuous strip, generally of paper material, around a core; a feeder that feeds the core into the take-up device and causes the tearing of the strip when the core is changed; a punching machine to perforate the strip in order to facilitate its tearing; and tensioning cylinders arranged along the path of the continuous strip to ensure correct tensioning and a uniform speed.

The take-up devices currently in use comprise a roller known as a master roller, which defines the speed of advancement of the continuous strip, and a roller to support the core during winding.

The take-up devices known in the prior art consist of an arched channel suitable to guide the core in the winding zone; a core feeding system to introduce the core into the arched channel; and a tearing device to cause the tearing of the continuous strip and, thus, its winding on the new core.

The arched channel is defined by the master roller and by a stationary cradle concentric to the master roller so that the arched channel has a constant height that is equal to the diameter of the core.

The tearing device comprises a rotating tooth that, controlled in synchronism with the introduction of the core into the arched channel, hits the continuous strip and presses it against the master roller. The continuous strip, slowed down by said impact and, at the same time, pulled by the master roller, is thus torn and starts winding around the core that is in the channel.

An example of a rewinding machine is described in WO9421545.

The prior art described above has a number of significant drawbacks.

A first important drawback lies in the fact that, when using cores of different diameters, the entire rewinding machine must be stopped in order to remove and replace the cradle, which results in considerable down times.

Note that this is a particularly important problem and, despite the high cost of rewinding machines, paper mills are actually often obliged to purchase a number of rewinding machines, to have one for each core diameter.

Another drawback consists in the fact that the impact of the rotating tooth against the master roller, which is very long and only supported at the ends, produces vibrations that are transmitted to the entire rewinding machine, and can cause malfunctions, for example in the punching machine and, in some cases, may deform the master roller.

In an attempt to overcome these drawbacks, feeding devices have been developed in which, instead of the rotating tooth and cradle, there is a rectilinear tearing channel upstream of the master roller.

Such feeding devices comprise a belt driven by the master roller and along which the continuous strip slides, a plate parallel to the belt so as to define said rectilinear channel and an actuating system to translate the plate in order to vary the cross-section of the channel.

In this case, tearing is performed by setting a cross-section of the channel smaller than that of the core so that when the core enters the channel, it presses the strip against the guide. The strip is thus slowed down and pulled by the master roller, it is torn and then starts winding around the incoming core.

An example of this feeding device is described in WO2011117827.

Although this system at least partially overcomes the problems described above, it has other inconveniences.

A first inconvenience lies in the fact that, in the strip tearing process, the core is pressed between the roller and the plate and so subjected to stress and deformation, which results in incorrect winding of the paper.

Such deformation is relatively substantial since the pressure of the core on the strip must be particularly high to prevent the core from passing through the channel without causing the tear.

Another inconvenience is that the tearing point is not particularly precise/constant and, in some cases, the edge of the continuous tape is too long and folds back on itself, resulting in incorrect winding around the core.

It is important to note that this inconvenient is also a feature of the rewinding machine described previously.

SUMMARY OF THE INVENTION

In this situation the technical purpose of the present invention is to devise a rewinding machine able to substantially overcome the drawbacks mentioned above.

Within the sphere of said technical purpose one important aim of the invention is to provide a rewinding machine that tears the continuous strip without causing vibrations or other problems in said rewinding machine.

In particular, an important aim of the invention is to provide a rewinding machine that tears the continuous strip without deforming the core and/or the master roller. Another aim of the invention is to develop a rewinding machine that can be easily and quickly adapted for use with cores of different diameters.

A no less important aim of the invention is to provide a rewinding machine that always achieves perfect winding of the strip on the core.

The technical purpose and specified aims are achieved with a rewinding machine as claimed in the appended claim 1 which describes a rewinding machine comprising a winding zone in which a continuous strip is wound around a core; a movement unit of the continuous strip defining a sliding surface for said continuous strip; a support unit defining a support surface for the core opposite and spaced from the sliding surface so as to define a sliding channel to guide the core in the winding zone; a contrast unit defining a contrast surface having a different speed from the speed of the sliding surface and arranged between the support surface and the contrast surface; and a tearing tooth suitable to press the continuous strip against the contrast surface causing the tearing of said continuous strip by rotating with a tangential speed substantially equal to the speed of the contrast surface. Preferred embodiments are described in the dependent claims.

BRIEF DESCRIPTION OF THE DRAWINGS

Further characteristics and the advantages of the invention are clearly evident from the following detailed description of a preferred embodiment thereof, with reference to the accompanying drawings, in which:

FIG. 10 is a detail of the rewinding machine according to an alternative embodiment with respect to those shown in FIGS. 5, 6 and 8;

FIG. 11 is another alternative embodiment of a detail of the rewinding machine.

DESCRIPTION OF PREFERRED EMBODIMENTS

Figure 1:
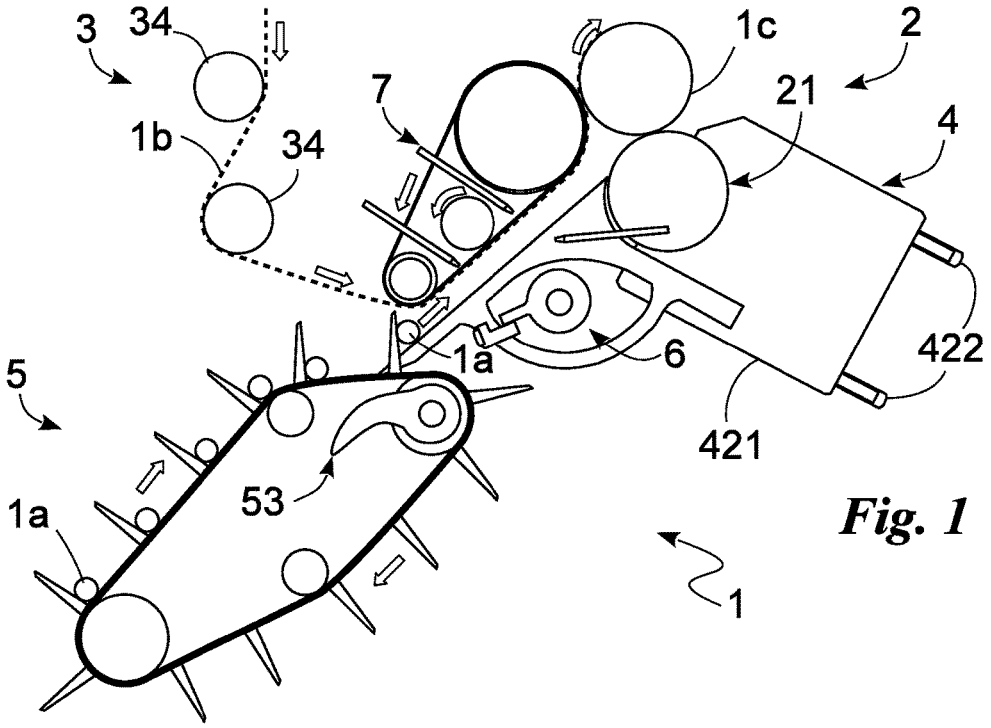
FIG. 1 illustrates the rewinding machine.

In this document, measurements, values, forms and geometric data (such as perpendicularity and parallelism), when used with terms such as "about" or other similar terms such as "practically" or "substantially", are to be considered without any measurement errors or inaccuracies due to production and/or manufacturing errors and, above all, without any slight divergence from the value, measurement, form or geometric data with which they are associated. For example, such terms, when associated with a value, preferably indicate a difference of not more than 10% of said value.

With reference to said Figures, reference numeral 1 globally denotes the rewinding machine according to the invention.

It is suitable to be used to wind a continuous strip 1*b*, preferably of paper material, around a core 1*a*, in order to obtain a log 1*c*.

The rewinding machine 1 comprises a winding zone 2 in which the strip 1*b* is wound around the core 1*a* to form the log 1*c*; a movement unit 3 of the continuous strip 1*b* defining a sliding surface 3*a* for the continuous strip 1*b*; a support unit 4 defining a support surface 4*a* for the core 1*a* opposite and spaced from the sliding surface 3*a* so as to define a sliding channel 4*b* suitable to guide the core in the zone 2; a loading unit 5 suitable to push the core 1*a* in the sliding channel 4*b*; and not illustrated in the figure, and a punching machine suitable to perforate the continuous strip 1*b* to facilitate its tearing.

Note that the punching machine is suitable to perform a plurality of lines of perforations in the strip 1*a*. Said lines of perforations are equally spaced apart from one another along the direction of advancement of the continuous strip 1*b*. The movement unit 3 defines the path of advancement of the strip 1*b* and, advantageously, a sliding surface 3*a* that is in contact with the continuous strip 1*b* and movable so as to define the speed of advancement of said continuous strip 1*b*.

It comprises at least one sliding belt 31 defining the sliding surface 3*a*; a motor-powered master roller 32 controlling the advancement of the belt 31 and, thus, of the continuous strip 1*b*, an idle sliding roller 33 on which the sliding belt 31 slides; a tensioner suitable to guarantee the correct tensioning of the belt 31; and one or more tensioning cylinders 34 arranged along the path of the strip 1*b* which ensure the correct tensioning and uniform speed of the continuous strip 1*b*.

Figure 9:
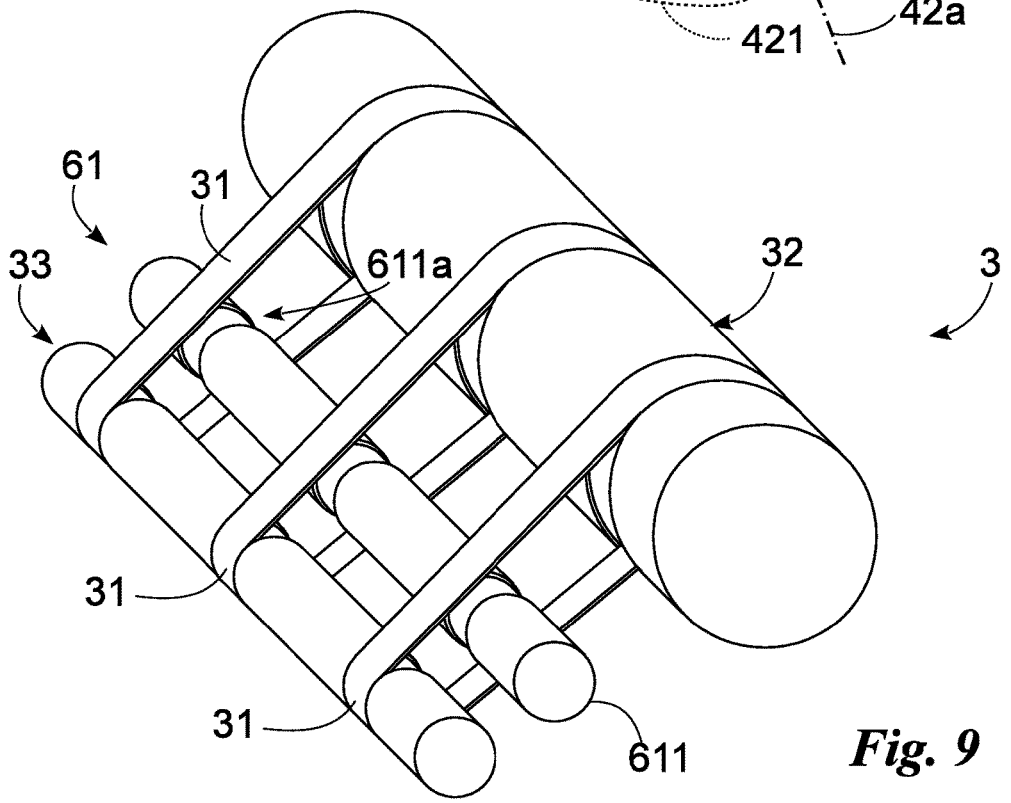
FIG. 9 shows a detail of FIG. 8.

Preferably, the unit 3 (FIG. 9) includes several sliding belts 31 appropriately practically equally spaced apart from one another so as to ensure the correct spreading of the continuous strip 1*b* and each defining a portion of the surface 3*a*. More preferably, the movement unit 3 includes seven sliding belts 31.

At least one sliding belt 31 is engineered so as to form a closed ring surrounding at least the rollers 32 and 33.

Figure 5:
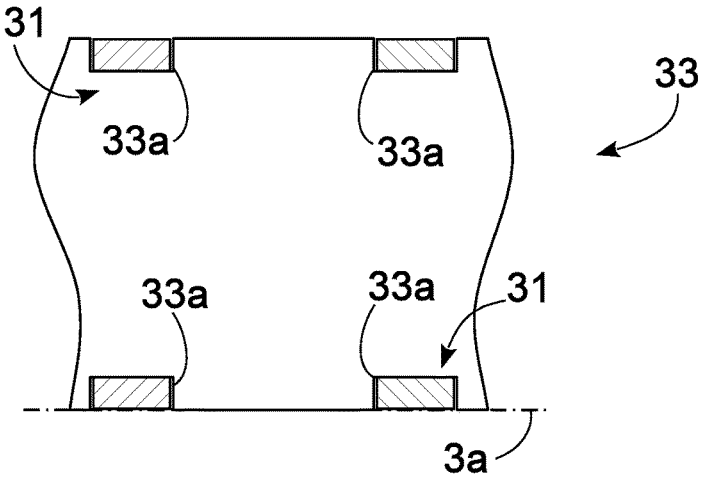
FIG. 5 illustrates a detail of the rewinding machine according to the invention.
Figure 6:
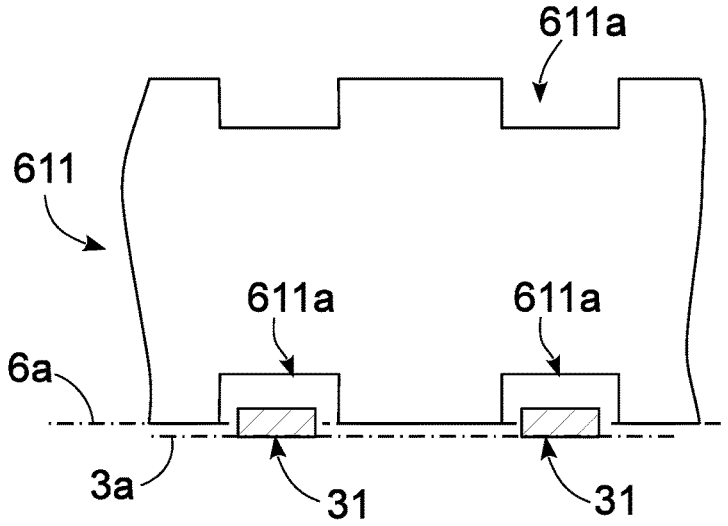
FIG. 6 shows another detail of the rewinding machine.
Figure 7:
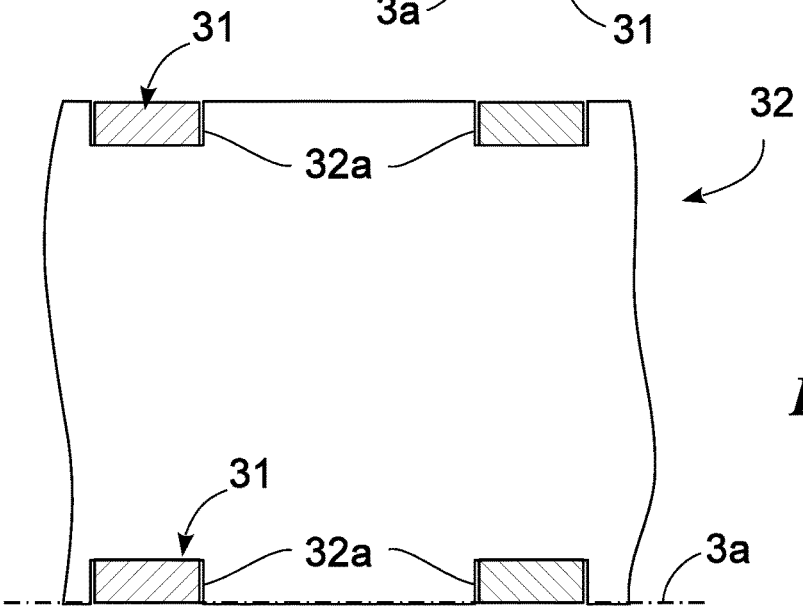
FIG. 7 presents a further detail of the rewinding machine.

The master roller 32 (FIG. 7) and/or the sliding roller 33 (FIG. 5) may have, in correspondence with each sliding belt 31, sliding grooves 32*a* and 33*a* the depth of which is substantially equal to the thickness of the sliding belts 31 so that the outside surface of the roller 32 and/or 33 is practically smooth and has a substantially constant diameter. In particular, the sliding grooves 32*a* and 33*a* are practically counter-shaped with respect to the belts 31.

The winding zone 2 is defined by the master roller 32 and by a support roller 21, appropriately motor-powered, which supports the log 1*c* being formed, that is to say the core 1*a* during the winding of the strip 1*b*.

The support unit 4 comprises at least one ramp 41 defining a support surface 4*a* that is appropriately substantially rectilinear and, preferably, practically stationary during the winding, and a regulator 42 suitable to move at least the ramp 41 to vary the distance between the support surface 4*a* and the sliding surface 3*a* and, thus, adjust the height of the sliding channel 4*b*, calculated practically perpendicularly to the longitudinal axis of said sliding channel 4*b*, substantially equal to the diameter of the core 1*a*.

Note that the support unit 4 may comprise several ramps 41 arranged side by side, appropriately equally spaced and each defining a portion of the support surface 4*a* so as to support the core 1*a* properly along its entire length. Preferably, there are seven or nine ramps 41.

The ramps 41 are arranged over the belts 31 and, appropriately, have a width, calculated practically perpendicularly to the direction of advancement of the continuous strip 1*b*, practically equal to that of the sliding belts 31.

Note that the ramps 41 are arranged above the belts 31 so as to leave enough manoeuvring space between them for at least the loading unit 5.

The support surface 4*a* is practically parallel to or arranged slightly crosswise with respect to the sliding surface 3*a* so as to have a sliding channel 4*b* that is practically rectilinear. In detail, the support surface 4*a* is substantially inclined with respect to the sliding surface 3*a* so that the cross-section of the inlet through which the core enters the channel 4*b* is smaller than the cross-section of the outlet from the channel 4*b*. Appropriately, the angle of inclination between the surfaces 3*a* and 4*a* is substantially less than 10°, more in detail 5°, and even more in detail, less than 2°. To be more precise, said angle is practically comprised between 0° and 1° and, more precisely, between 0.2° and 0.6°.

Preferably, the sliding channel 4*b* has a height, at least at the inlet cross-section, substantially equal to the diameter of the core 1*a*.

The sliding surface 4*a* is a high friction surface to prevent any undesirable slipping of the core 1*a*. Therefore, the surface 4*a* of the ramp 41 may be coated in rubber or another high friction material.

The regulator 42 is suitable to move the ramp 41 along a traverse axis 42*a* that is practically transversal and, in particular, inclined with respect to the sliding surface 4*a*.

Figure 8:
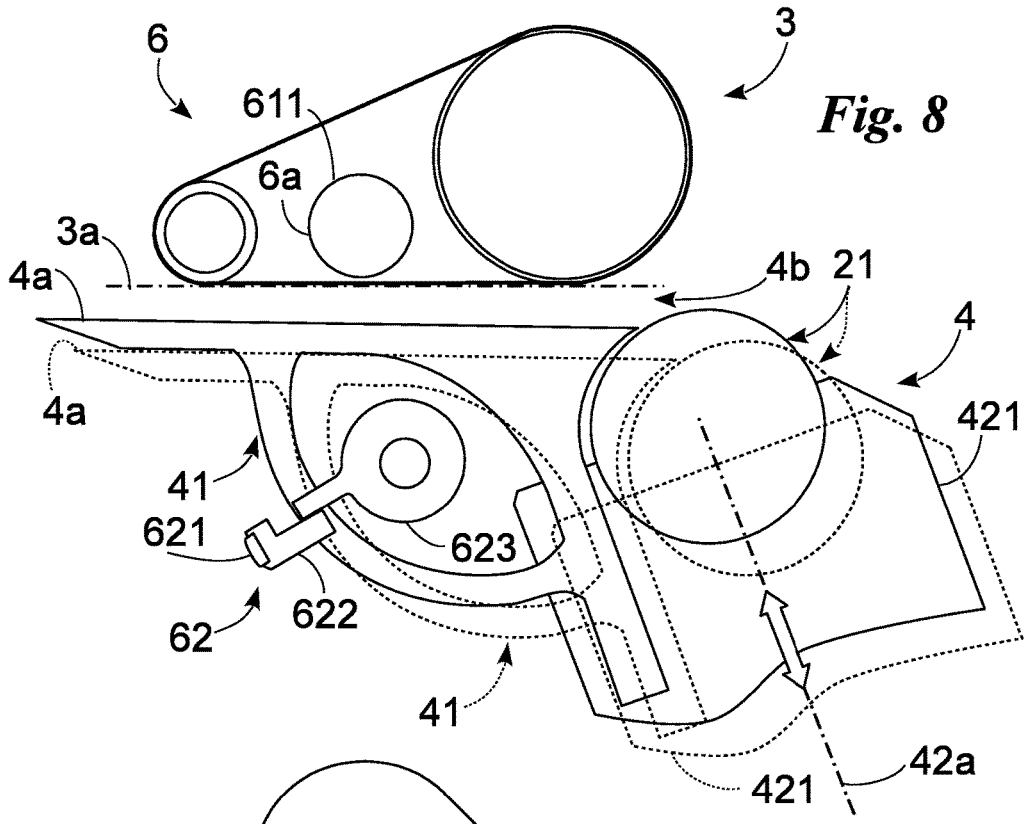
FIG. 8 is an assembly drawing of the rewinding machine according to the invention.

Preferably, it is suitable to simultaneously translate the ramp 41 and the support roller 21 in order to vary the cross-section of the sliding channel 4*b* and the winding zone 2 (FIG. 8).

The regulator 42 comprises a slider 421 associated with the at least one ramp 41 and, in some cases, with the support roller 21; at least one guide 422 guiding the motion of the slider 421 along the traverse axis 42*a*; and an actuator suitable to move the slider 421 along the guide 422.

At the inlet cross-section of the channel 4*b*, the rewinding machine 1 is equipped with at least one loading unit 5 and, in detail, several units 5 appropriately alternating with respect to the ramps 41 so as not to interfere with one another and keep the core 1*a* perpendicular to the longitudinal axis of the channel 4*b*.

Appropriately there are four loading units 5.

Each loading unit 5 comprises a conveyor 51, appropriately a belt conveyor, suitable to pick up at least one core 1*a* from the loading station; one or more cylinders 52, at least one of which is motor-powered, suitable to control the motion of the conveyor 51, a feeder hand 53 suitable to push the core 1*a* into the sliding channel 4*b*, preferably by rotating.

Additionally, the loading unit 5 may comprise one or more projections 54 protruding from the conveyor 51 so as to guarantee the correct movement of the cores 1*a* along the conveyor 51.

The hand 53 and the projections 54 are staggered with respect to one another along a direction perpendicular to the advancement of the continuous strip 1*b* so as not to collide with one another. The hand 53 and the projections 54 are also arranged in such a way as to operate in the manoeuvring space defined by the ramps 41 and the belts 31.

The rewinding machine 1 further comprises a tearing unit 6 suitable to tear the continuous strip 1*b* so that it can be wound around the new core 1*a* entering the sliding channel 4*b*; and an advancement control unit suitable to calculate the advancement of the continuous strip 1*b* and, thus, the number of meters of strip 1*b* wound around the core 1*a*.

The advancement control unit makes it possible to know how many meters of strip 1*b* have been wound on the core 1*a* and, thus, to control tearing by the tearing unit 6 when a previously defined number of meters of continuous strip 1*b* have been wound on the core 1*a*.

It is also capable of recognising the position of each line of perforations along the path of the strip 1*b* according to the meters of strip 1*b* moved and the distance between adjacent lines of perforations.

The contrast assembly 6 comprises, in brief, a contrast unit 61 defining a contrast surface 6*a*; and at least one tearing tooth 62 suitable to press the continuous strip 1*b* against the contrast surface 6*a* causing the tearing of said continuous strip 1*b*. The contrast surface 6*a* is separate from the sliding surface 3*a* and support surface 4*a*. In particular, it is arranged so that the sliding surface 3*a* is interposed between the support surface 4*a* and the contrast surface 6*a*.

The contrast unit 61 comprises a contrast roller 611 defining the contrast surface 6*a* and preferably arranged inside the closed ring defined by the sliding belts 31.

The contrast surface 6*a* is, thus, defined by the outside surface of said contrast roller 611 and its distance from the sliding surface 3*a*, calculated practically perpendicularly to the surfaces 3*a* and 6*a*, is substantially less than 1 cm, in particular, practically less than 5 mm, more in particular, practically less than 1 mm. Preferably said distance is substantially comprised between 1 mm and 0.1 mm and, preferably, it is practically equal to 0.3 mm.

The roller 611 is appropriately motor-powered so that the contrast surface 6*a* has a speed substantially different and, in particular, substantially lower than that of the sliding surface 3*a*. More in particular, the speed of the contrast surface 6*a* is practically comprised between 100% and 70%, and, yet more in particular, between 100% and 85% and, preferably, between 98% and 90% of the speed of the sliding surface 3*a*.

The contrast roller 611 may be provided with one or more idle sliding seats 611*a* for the belts 31.

The seats 611 are suitable to house at least part of the cross-section of the sliding belts 31 to allow the sliding belts 31 to protrude from the contrast roller 611 and, thus, have a sliding surface 3*a* that is separate from the contrast surface 6*a*.

They have a cross-section that is substantially greater than that of the sliding belts 31 so that the belts 31 slide idly with respect to the contrast roller 611 and are therefore not subject to changes in speed owing to the separate speeds of the contrast roller 611 and the surface 3*a*.

In some cases, the contrast roller 611 may consist of a motor-powered central shaft, one or more bushings integral with the central shaft and reciprocally spaced so that an idle sliding seat 611*a* is defined between each pair of adjacent bushings.

Its distance from the master roller 32, calculated at the point in which the strip 1*b* first comes into contact with the rollers 611 and 32, is substantially less than 25 cm, in particular, less than 20 cm and, more in particular, substantially comprised between 10 cm and 15 cm.

The contrast assembly 6 preferably has several tearing teeth 62 and, precisely, at least four teeth 62.

The teeth 62 are arranged in the manoeuvring space that is defined so that, when they rotate, they do not collide with the ramps 41 and/or the belts 31 but practically exclusively press the continuous strip 1*b* against the contrast roller 611.

One tooth 62 comprises an insert 621 suitable to press the strip 1*b* against the tearing surface 6*a*, a support 622 for the insert 621, a central body 623 sustaining the support 622 and the insert 621; a motor suitable to drive the rotation of the central body 623 and, as a consequence, of the insert 621; and adjusting means suitable to adjust the position of the support 622 with respect to the central body 623 by varying the distance of the insert 621 from the axis of rotation of the tooth 62.

In particular, the motor is suitable to control the rotation of the tooth 62 by defining a tangential speed, calculated on the profile of the insert 621 farthest from the axis of rotation, practically the same as the speed of the contrast surface 6*a* and, thus, substantially lower than that of the sliding surface 3*a*. Note that the delta between the speed of the insert 621 and that of the tearing surface 6*a* is practically null whereas the delta between the speeds of the insert 621 and sliding surface 3*a* is substantially not null.

The rotation of the tearing tooth 62 is preferably substantially synchronous with the rotation of the feeder hand 53.

Lastly, the rewinding machine 1 may comprise at least one from among: a gluing unit suitable to apply at least a strip of adhesive material on the core 1*a*; and at least one blower unit 7 suitable to facilitate the winding of the continuous strip 1*b* on the core 1*a* in the sliding channel 4*b*.

Appropriately, the rewinding machine is provided with several blower units arranged in the manoeuvring space defined by the ramps 41 and the belts 31. Each blower unit 7 is in a pressurised air circuit having at least one nozzle 71 suitable to direct a jet of air which, when it hits the strip 1*b* immediately after tearing, facilitates the winding of the strip 1*b* on the incoming core 1*a*.

In particular, it may be provided with at least a first nozzle 71 arranged on the opposite side of the support surface 4*a* with respect to the sliding surface 3*a* and at least a second nozzle 71 arranged on the opposite side of the sliding surface 3*a* with respect to the support surface 4*a*. More in particular, the blower unit 7 is provided with two first nozzles 71 practically parallel to one another, one of which is between the master roller 31 and the contrast roller 611, and one between the sliding roller 33 and the contrast roller 611; and only one second nozzle 71 arranged transversely with respect to the first nozzles 71 and situated between a support roller 21 and the tooth 62.

The functioning of the rewinding machine, described above in a structural sense, achieves an innovative procedure for rewinding a continuous strip 1*b* on a core 1*a*. The procedure comprises the sliding of a continuous strip 1*b* along a sliding surface 3*a*; the winding of the continuous strip 1*b* on the core 1*a*; when a log 1*c* is practically complete, the introduction of a core 1*a* into the channel 4*b*; the tearing of the continuous strip 1*b*; the winding of the continuous strip 1*b* on the core 1*a* passing through the sliding channel 4*b* and the discharging of the formed log 1*c*. The core is introduced by means of a projection 54 (FIG. 1) and, then, by the feeder hand 53 (FIG. 2) which pushes the core 1*a* into the channel 4*b*.

When it has entered the channel 4*b* the sliding surface 3*a* and, in particular, the strip 1*b* push the core 1*a* which thus passes along the entire sliding channel 4*b* and is discharged into the zone 2.

It is important to note that, thanks to the high level of friction of the support surface the core 1*a* passes along the sliding channel 4*b* by rolling and, in detail, with a purely rolling motion.

Tearing is performed as the core 1*a* passes along the channel 4*b*. Note that tearing of the strip 1*b* may also be performed before or when the core 1*a* is introduced into the channel 4*b*.

Figure 2:
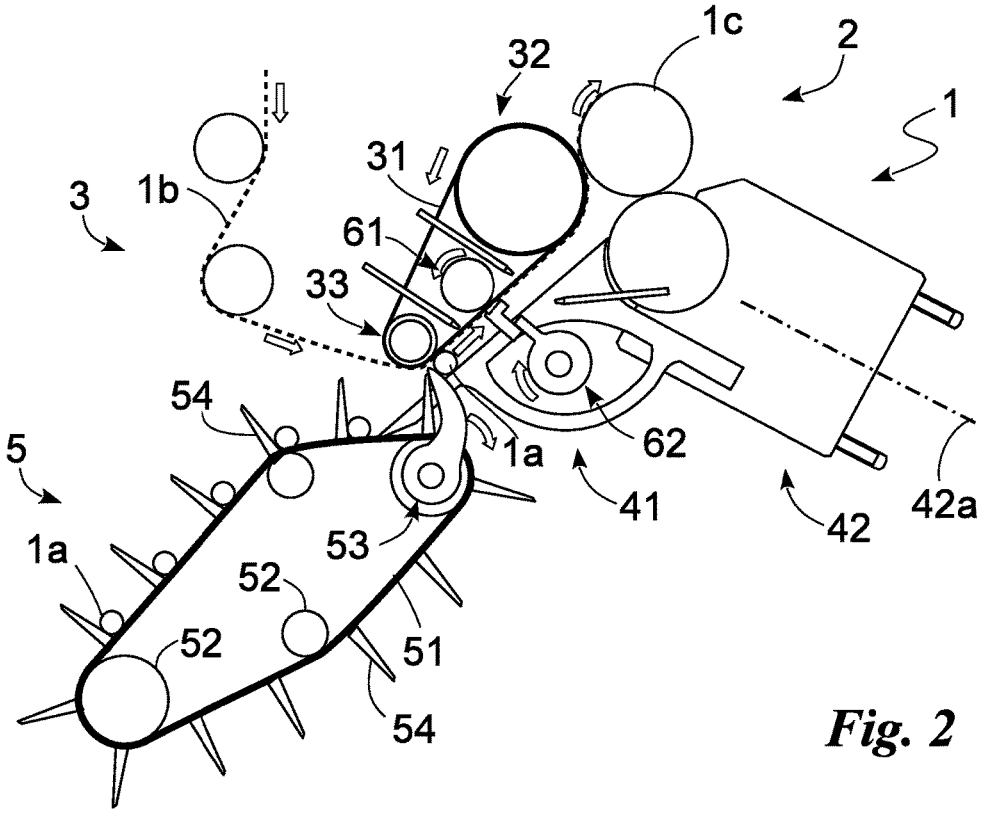
FIG. 2 illustrates the rewinding machine in another step of the work cycle.

To perform tearing, the control unit makes the tearing tooth 62 rotate, according to the advancement of the strip 1*b*, so that the insert 621 comes into contact with the strip 1*b* which is thus pressed against the tearing surface 6*a* and, precisely, against the contrast roller 611 (FIG. 2).

Note that the control unit controls the rotation of the strip 1*b* according to the speed of advancement thereof, so that the insert 621 comes into contact with the strip 1*b* when the tearing line is between the rollers 32 and 611 and, precisely, when it is at a distance from the contrast roller 611, calculated from the point at which the strip 1*b* first comes into contact with the roller 611, practically comprised between 1 and 6 cm and, in particular, between 2 and 4 cm.

Since the speed of the surface 6*a* is lower than that of the sliding surface 3*a* and of the strip 1*b*, when the insert 621 presses against the tearing surface 6*a*, at least the part of the continuous strip 1*b* immediately proximal to the contrast roller 611 slows down, while that downstream maintains the same speed, owing to the action of the master roller 32.

Therefore, the portion of continuous strip 1*b* proximal to the tooth 62 stretches and tears along a line of perforations between the contrast roller 611 and the master roller 32.

Figure 3:
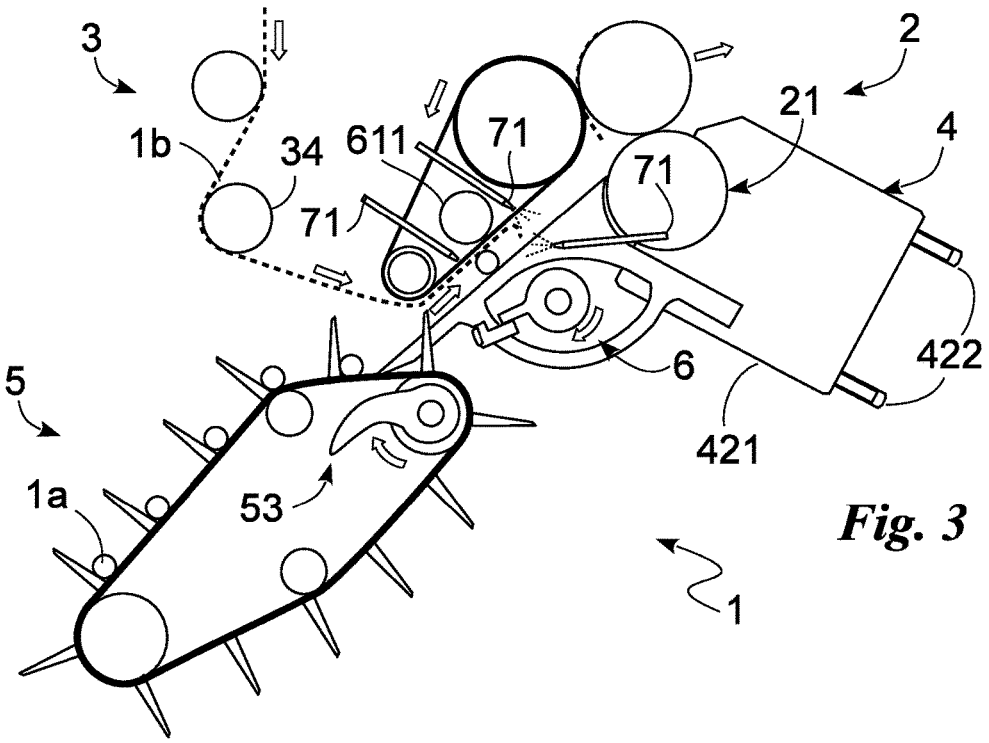
FIG. 3 illustrates the rewinding machine in a different step of the work cycle.
Figure 4:
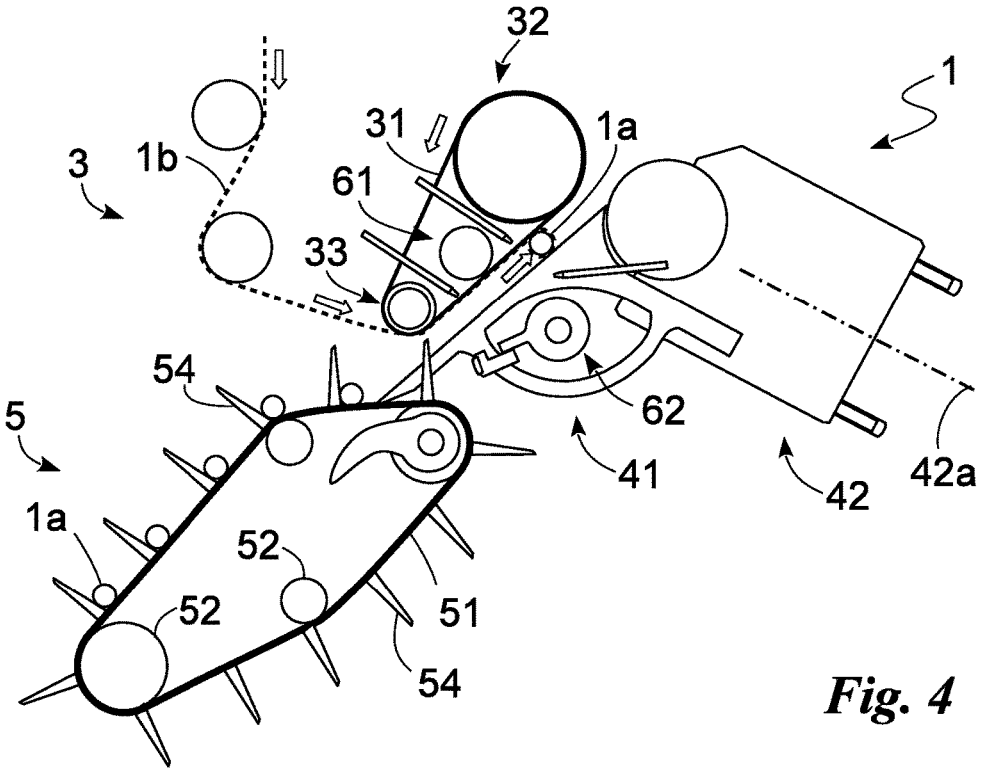
FIG. 4 illustrates the rewinding machine in yet another step of the work cycle.

When tearing has been performed, the tearing tooth 62 returns to the original position (FIG. 3).

At this point, the edge of the strip 1*b* downstream of the tear is wound on the log 1*c* which is then discharged, while the edge upstream of the tear is wound on the core 1*b* which is passing along the sliding channel 4*b* to start a new winding step. Note that such winding may optionally be assisted by a jet of air delivered through the one or more nozzles 71.

The invention achieves some important advantages.

A first advantage is given by the fact that because the tearing tooth 62 presses against a tearing surface 6*a* that is separate from the master roller 32, the tensions and deformations of the master roller 32 typical of the prior art rewinding machines are avoided.

This aspect is further guaranteed by the null delta between the speed of the tearing surface 6*a*, the speed of the insert 621 and, thus, of the tooth 62 so that the stress on the rewinding machine 1 is practically null.

A further advantage lies in the extreme flexibility of use of the rewinding machine 1 and, precisely, the possibility of using cores 1*b* of different diameters.

Indeed, the regulator 42 can be used to move the ramp 41 and, thus, the support surface 4*a* with respect to the sliding surface 3*a*, to adapt the height of the sliding channel 4*b* to the core 1*a*.

Another advantage lies in the fact that the tearing device 6 does not require the height of the channel 4*b* to be less than the diameter of the core 1*a* and, therefore, does not stress and deform said core 1*a* as happens with the rewinding machine described in WO2011117827.

This aspect is further enhanced by the fact that the support surface 4*a* and sliding surface 3*a* are inclined with respect to one another. Owing to said reciprocal inclination, the sliding channel does not squeeze and deform the core 1*a* even when the diameter of said core 1*a* increases due to the continuous strip 1*b* that is wound on the core 1*a* when it is still in the channel 4*b*.

Another no less important advantage consists in the fact that the tearing point is practically constant. Therefore, by synchronising the feeder hand 53 and the tooth 62, it is possible to prevent the edge of the continuous strip 1*b* from folding back on itself after tearing, which would prevent imperfect winding on the core.

Indeed, since the distance between the contrast roller 611 and the master roller 32 is shorter, the zone between said rollers 611 and 32 can be smaller so that there is only one line of perforations between the contrast roller 611 and the master roller 32.

Modifications and variations may be made to the invention described herein without departing from the scope of the inventive concept as expressed in the independent and dependent claims. All details may be replaced with equivalent elements and the scope of the invention includes all other materials, shapes and dimensions.

In particular, the contrast surface 6*a*, instead of being defined by the outside surface of the contrast roller, is substantially flat and preferably practically parallel to the sliding surface 3*a*.

As described previously, its distance from the sliding surface 3*a*, calculated just about perpendicularly to the surfaces 3*a* and 6*a*, is substantially less than 1 cm, in particular, practically less than 5 mm, more in particular, practically less than 1 mm. Preferably said distance is substantially comprised between 1 mm and 0.1 mm and, preferably, it is practically equal to 0.3 mm.

The contrast surface 6*a* has a speed substantially different from and, in particular, substantially lower than that of the sliding surface 3*a*. More in particular, the speed of the contrast surface 6*a* is practically lower than that of the sliding surface 3*a*, yet more in particular, practically comprised between 100% and 70%. Preferably, the speed of the contrast surface 6*a* is practically comprised between 100% and 85%, and, more preferably, between 98% and 90% of the speed of the sliding surface 3*a*.

In this case, the contrast unit 61 may comprise, in addition to the contrast roller 611, at least one contrast belt 612 (preferably at least four) defining, instead of the roller 611, the contrast surface 6*a* and moved by the contrast roller 611; and one or more idle rollers suitable to keep the at least one contrast belt 612 tensioned. Preferably, the contrast unit 61 comprises several contrast belts 612 appropriately spaced an equal distance apart from one another and each defining a portion of the contrast surface 6*a*. In particular, the contrast belts 612 are appropriately staggered with respect to the at least one sliding belt 31 and, specifically, arranged in the manoeuvring space so as not to overlap one another in order to allow the tearing tooth 62 to come almost exclusively into contact with a single belt 612 without striking the sliding belt 31.

The contrast roller 611 may be provided with one or more housing grooves 611*b* for the contrast belts 612, preferably having a depth substantially equal to the thickness of the belts 612 so that the outside surface of the roller 611 is substantially flush with the contrast belts 612. In particular, the housing grooves 611*b* are counter-shaped with respect to the contrast belts 612.

Figure 12:
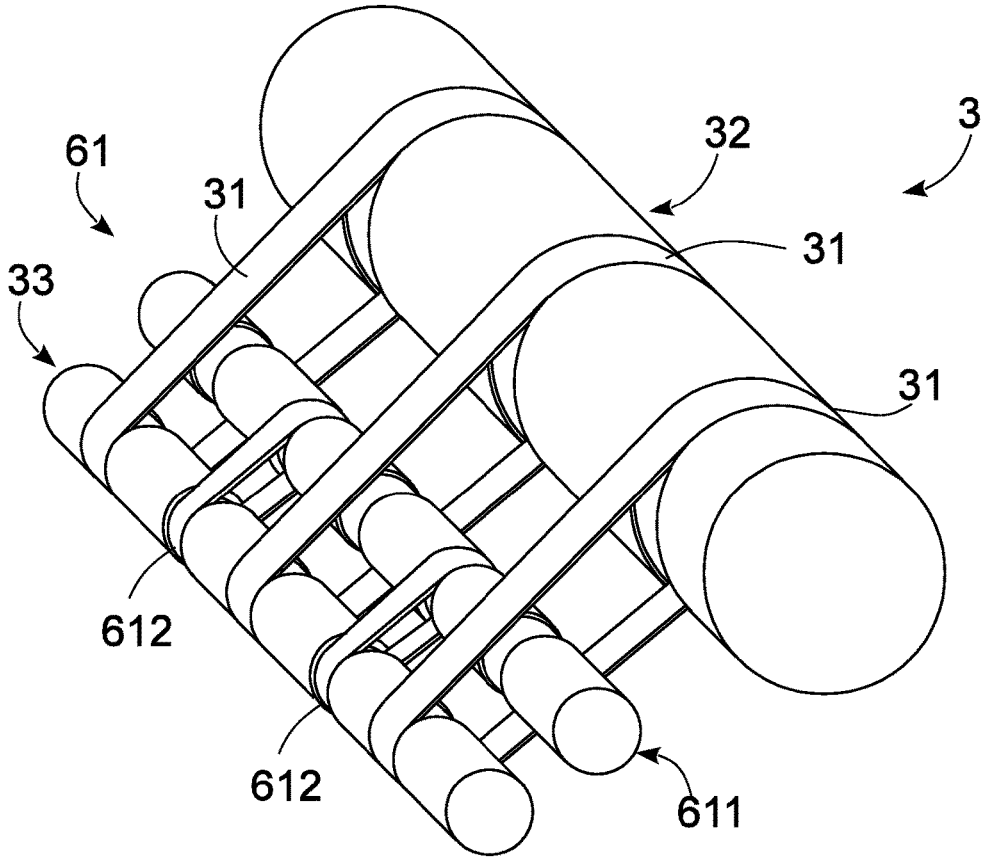
FIG. 12 shows a further alternative embodiment of a detail of the rewinding machine.

The contrast roller 611 may be arranged inside the closed ring defined by the sliding belts 31 (FIG. 12). It is provided with one or more idle sliding seats 611*a* suitable to house at least part of the cross-section of the sliding belts 31 to allow the sliding belts 31 to protrude from the contrast roller 611.

The idle sliding seats 611*a*, as described above, are suitable to house at least part of the cross-section of the sliding belts 31 to allow the sliding belts 31 to protrude from the contrast roller 611 and, thus, have a sliding surface 3*a* that is separate from the contrast surface 6*a*.

They have a cross-section that is substantially greater than that of the sliding belts 31 so that the belts 31 slide idly with respect to the contrast roller 611 and are therefore not subject to changes in speed owing to the different speeds of the contrast roller 611 and the surface 3*a*.

In some cases, the contrast unit 61 may comprise bearings 611*c*, bushings or other similar elements housed in the seats 611*a* so as to be interposed between the sliding belts 31 and the contrast roller 611 to permit an idle motion between said belts 31 and said roller 611 (FIGS. 11-12).

Alternatively, the depth of the housing grooves 611*b* is substantially greater than the thickness of the contrast belts 612; whereas the depth of the idle sliding seats 611 is substantially equal to the thickness of the sliding belts 31 which are thus flush with the outside surface of the contrast roller 611. According to another alternative embodiment, the roller 611 comprises first pulleys that control the motion of the contrast belts 612 and define the grooves 611*b* and idle pulleys defining the seats 611*a* and having a diameter greater than that of the first pulleys so that the belts 612 and 31 define separate surfaces 6*a* and 3*a*.

The contrast unit 61 comprises a single idle roller which is preferably the sliding roller 33 on which the contrast belt 612 and the sliding belt 31 slide, at different speeds.

As a consequence, in addition to the grooves 33*a*, the sliding roller 33 comprises one or more additional sliding grooves 33*b* the depth of which is greater than the thickness of the contrast belts 612 which are thus housed entirely therein; and additional bearings 33*c*, bushings or similar elements housed in the additional sliding grooves 33*b* so as to be interposed between the contrast belts 612 and the sliding roller 33 to permit an idle motion between the contrast belts 612 and the sliding roller 33 (FIG. 10).

Alternatively, the sliding roller 33 may comprise additional first pulleys for the sliding belts 31 and additional idle pulleys for the contrast belts 612 with a diameter smaller than the additional first pulleys so that the belts 31 and 612 define separate surfaces 6*a* and 3*a*.

The at least one contrast belt 612 is arranged so as to form a closed ring surrounding the contrast roller 611 and the one or more idle rollers of the contrast unit 61. Preferably, each contrast belt 612 forms a closed ring surrounding the contrast roller 611, and the sliding roller 33 (FIG. 12).

The invention claimed is:

1. A rewinding machine, comprising:

a winding zone comprising a continuous strip wound around a core, the continuous strip comprising a movement unit defining a sliding surface for said continuous strip;

a support unit defining a support surface for said core, said support surface being opposite and spaced from said sliding surface so as to define a sliding channel to guide said core in said winding zone;

a contrast unit defining a contrast surface having a speed different from the speed of said sliding surface;

at least one tearing tooth configured to press said continuous strip against said contrast surface causing the tearing of said continuous strip by rotating with a tangential speed substantially equal to said speed of said contrast surface; and wherein said sliding surface is interposed between said support surface and said contrast surface.

2. The rewinding machine according to claim 1, wherein said contrast surface has a speed lower than said speed of said sliding surface.

3. The rewinding machine according to claim 2, wherein said contrast surface has a speed substantially comprised between 98% and 90% of said speed of said sliding surface.

4. The rewinding machine according to claim 1, wherein said contrast surface has a distance from said sliding surface substantially comprised between 1 mm and 0.1 mm.

5. The rewinding machine according to claim 1, wherein said movement unit comprises at least one sliding belt defining said sliding surface;

a master roller controlling the motion of said at least one sliding belt; and an idle sliding roller for said at least one sliding belt;

wherein said contrast unit comprises a contrast roller defining said contrast surface.

6. The rewinding machine according to claim 5, wherein said at least one sliding belt forms a closed ring surrounding said master roller, said sliding roller and said contrast roller; and wherein said contrast roller comprises at least one idle sliding seat for said at least one sliding belt.

7. The rewinding machine according to claim 1, wherein said support surface is inclined with respect to said sliding surface.

8. The rewinding machine according to claim 7, wherein said support surface is inclined with respect to said sliding surface by an angle substantially comprised between 0.2° and 0.6°.

9. The rewinding machine according to claim 1, wherein said support unit comprises at least one ramp defining said support surface and a regulator configured to move said at least one ramp varying the distance between said support surface and said sliding surface making the height of said sliding channel substantially equal to the diameter of said core.

10. A rewinding procedure configured to be implemented by a rewinding machine according to claim 1, said rewinding procedure comprising:

the sliding of said continuous strip along said sliding surface;

the introduction and advancement of said core in said sliding channel;

the tearing of said continuous strip by means of said at least one tearing tooth pressing said continuous belt against said tearing surface interposed between said support surface and said contrast surface; and the winding of said torn continuous strip on said core in said sliding channel;

wherein said contrast surface has a speed substantially different than the speed of said sliding surface and said tearing tooth presses said continuous strip against said contrast surface by rotating with a tangential speed substantially equal to said speed of said contrast surface.

11. The rewinding procedure according to claim 10, wherein said contrast surface has a speed lower than said speed of said sliding surface.

12. The rewinding procedure according to claim 11, wherein said contrast surface has a speed substantially comprised between 98% and 90% of said speed of said sliding surface.

* * * * *